US005556088A

United States Patent [19]

Mower et al.

[11] Patent Number: 5,556,088

[45] **Date of Patent: *Sep. 17, 1996**

[54] APPARATUS AND METHOD FOR PACKAGING A BASKETBALL GOAL SYSTEM WITH WEIGHT-FILLABLE BASE

[75] Inventors: Barry D. Mower, Layton; Lonny R. Matherne, Plain City, both of Utah

[73] Assignee: Lifetime Products, Inc., Clearfield, Utah

[ * ] Notice: The term of this patent shall not extend beyond the expiration date of Pat. No. 5,248,140

[21] Appl. No.: 366,226

[22] Filed: Dec. 29, 1994

Related U.S. Application Data

[63] Continuation-in-part of Ser. No. 97,678, Jul. 27, 1993, Pat. No. 5,377,976, which is a continuation-in-part of Ser. No. 13,611, Feb. 4, 1993, Pat. No. 5,248,140.

[51] Int. Cl.[6] ..... A63B 63/08; F16M 13/00

[52] U.S. Cl. ..... 273/1.5 R; 206/315.1; 206/579

[58] Field of Search ..... 273/1.5 R, 1.5 A; 206/315.1, 579; 248/519–529, 910, 346.04

[56] References Cited

U.S. PATENT DOCUMENTS

| | | | |
|---|---|---|---|
| 2,929,601 | 3/1960 | Anderson | 248/346.04 |
| 4,494,754 | 1/1985 | Wagner, Jr. | 248/346.04 X |
| 4,826,162 | 5/1989 | Allen | 206/315.1 X |
| 4,842,134 | 6/1989 | Chang | 206/315.1 |
| 4,979,754 | 12/1990 | Eisenhart | 206/315.1 |
| 5,112,023 | 5/1992 | Sowers | 73/1.5 R |
| 5,207,407 | 5/1993 | Fitzsimmons et al. | 273/1.5 R |
| 5,248,140 | 9/1993 | Matherne et al. | 273/1.5 R |

*Primary Examiner*—Paul E. Shapiro
*Attorney, Agent, or Firm*—Madson & Metcalf

[57] ABSTRACT

A portable basketball system that in a preassembled state is capable of disposition within an outer relatively flat container to assist in shipping. The basketball system comprises a pole, a backboard, a basketball goal, and a hollow ballast-receiving base. The pole has a proximate end and a distal end and comprises a plurality of pole sections. The backboard may be connected to the pole near the distal end of the pole. The basketball goal may be connected to the backboard. The hollow ballast-receiving base supports the pole in a stationary, substantially upward disposition when connected to the pole near the proximate end of the pole. This provides a pole upon which the basketball goal may be suspended at an elevation above a playing surface and the base. The base has a top and a bottom and an exterior contour for receiving and retaining the pole sections, backboard, and basketball goal within the container during preassembly thereby impeding shifting movement of the pole sections, backboard, and basketball goal within the container during shipping. The exterior contour of the base comprises a backboard recess disposed on the bottom of the base for receiving and retaining the backboard within the container, a goal recess disposed on the top of the base for receiving and retaining the basketball goal within the container, and a pair of notches disposed on the top of the base each notch for receiving and retaining at least one of the pole sections within the container.

19 Claims, 9 Drawing Sheets

APPARATUS AND METHOD FOR PACKAGING A BASKETBALL GOAL SYSTEM WITH WEIGHT-FILLABLE BASE

RELATED U.S. APPLICATIONS

This application is a continuation in part of U.S. patent application Ser. No. 08/097,678, filed Jul. 27, 1993, now Pat. No. 5,377,976, and entitled PORTABLE BASKETBALL SYSTEM, which is a continuation in part of U.S. patent application Ser. No. 08/013,611, filed Feb. 4, 1993, now U.S. Pat. No. 5,248,140, entitled APPARATUS AND METHOD FOR PACKAGING A BASKETBALL GOAL SYSTEM WITH WEIGHT-FILLABLE BASE.

BACKGROUND

1. The Field of the Invention

The present invention is related to a basketball system with a weight-fillable base. More particularly, the present invention is related to a basketball system with a weight-fillable base having a unique design which enables the base to be moved when filled with ballast material and having a configuration that assists in the packaging of the component parts of the basketball system for shipment in a single relatively flat box.

2. Technical Background

As the game of basketball has increased in popularity, a greater number of people have purchased basketball systems for use at their homes. Such basketball systems typically comprise at least a pole to which a backboard and a goal is secured so that the goal is suspended above a playing surface. Heretofore most basketball systems were permanently mounted into the ground near the driveway of the home so that the driveway for the home serves as the basketball court. Few homes have sufficient land surrounding the home to dedicate space for exclusive use as a basketball court.

In some instances, locating where to permanently mount a basketball system can pose some difficulties. For example, at some homes, permanently mounting a basketball system next to the driveway could provide a risk to traffic in the driveway, resulting in danger or damage to both automobiles and the basketball system.

In some instances, the only viable location for mounting a basketball system could be in a location where permanently mounting a basketball system cannot be easily accomplished. Such a location could be where there is concrete or asphalt on the ground; thus, to mount the pole into the ground would require breaking a hole in the concrete or asphalt and then repairing the hole after the pole has been affixed in the ground. Such a procedure could be expensive and would most likely leave the driveway appearing unsightly.

Permanently installed outdoor basketball systems suffer from other disadvantages as well. Because they are permanently mounted, they are generally exposed to the weather throughout the entire year. Constant exposure to the weather can cause the basketball system to prematurely wear by promoting oxidation. Premature oxidation can be particularly troublesome in systems having moving parts, such as poles and backboards that employ adjustable height mechanisms or breakaway goals. Constant exposure to the weather can cause these mechanisms to prematurely fail.

Even permanently mounted basketball systems utilized in indoor environments suffer from some disadvantages. For example, a typical school has a gymnasium which must serve many purposes. Having several basketball systems permanently mounted, even if wall or ceiling mounted, for use in the gymnasium may preclude or at least interfere with certain other activities. On formal occasions, objection may be made to the appearance of permanently mounted basketball systems. The location of the permanently mounted basketball system may also interfere with other sporting activities.

In response to these and other disadvantages inherent in permanently mounted basketball systems, some designs for portable basketball systems have been developed. In order for the portable basketball system to be effective, sufficient weight must be employed to maintain the pole, backboard and goal in a generally rigid position for use in playing the game of basketball. Hence, some portable designs utilize a great deal of weight, making the systems particularly difficult to move and possibly requiring the assistance of several people to set up or remove the system. Additionally, such designs can be prohibitively expensive for people desiring to purchase one for use at their home.

Some prior-art designs have utilized removable weights, such as sand bags or metal weights, for use on a support structure which anchors the pole to the ground. A principal disadvantage to the use of these types of removable weights is that they can be extremely heavy to move from one place to another. While the support and the systems employing such designs may be easier to move, the weights are not. Some such designs, in an attempt to minimize the amount of removable weights required, are extremely large and bulky because they employ long lever arms in order to increase the effective weight of the removable weights.

In an attempt to make a portable basketball system that would be consumer affordable and ideal for use at home, some designs have employed a water-filled base. Such systems can be easily moved to a desired location where the base is then filled with water, thereby providing sufficient weight to maintain the pole, backboard and goal in a generally rigid position for use in playing basketball. When it is desired to move the system, the water is emptied out and the system moved. The principal advantage of such a system is in the use of water. Water is inexpensive, plentiful and convenient to use.

Such systems with water-filled base designs do suffer from some disadvantages, however. Having to fill and empty the base each time the system is to be set up or moved requires time, is wasteful of water, and is an inconvenience. Additionally, because water has a density of approximately 8.3 pounds per gallon, it requires several gallons of water to effectively support the system in a generally rigid position. Thus, when emptying the water out of the base, precautions have to be taken to ensure that the water is properly directed so it does not cause damage to the home or other surroundings. Also, the utilization of a water-filled base presents the hazard that the base receptacle or container aspect could be broken if the water within the base freezes and expands.

Some portable basketball systems have the pole onto which the backboard and goal assembly is secured disposed at an angle. This is generally done to provide sufficient horizontal distance between the base, which is generally pyramidic in shape and extends outwardly in all directions from the pole, and the backboard. Such pyramidic-shaped bases are bulky and cannot easily be packaged for shipping in a single relatively flat box. Hence, packaging and shipping costs for transporting this type of portable basketball system are considerably more than they would be if the system could be packaged into a single relatively flat container. This is an expense that is passed along to the consumer.

Most basketball backboards are designed to be secured to a vertical surface so that the rim portion of the goal lies in a horizontal plane above the playing surface. For example, most height adjustable systems, such as those disclosed and claimed in U.S. Pat. Nos. 4,781,375 and 4,805,904, require a vertical mounting surface. Of course, adapters may be employed, but they would unduly add to the cost and complexity of the system.

The development of various portable basketball systems has created a significant consumer demand for sturdy, low-cost portable basketball systems. Consumers are looking for an affordable alternative to the permanently mounted basketball system. Retail marketers of basketball systems are looking for basketball systems that can be easily displayed in a minimum of floor space and can be stacked to maximize inventory in the available shelf space. For example, a basketball system that can be packaged into a shipping carton that has a depth of about 14 inches can be stacked only six cartons high within a room with an 8 foot ceiling, while a carton of depth of about 8 inches can be stacked twelve cartons high in the same room. Such stacking ability also translates to significant shipping cost savings because more systems can be transported in a truck trailer or a box car.

Heretofore, although various portable basketball systems have been developed, there have been no such systems that could be packaged into a relatively flat shipping carton (for the purposes of this application the phrase "relatively flat" when applied to a shipping carton shall mean a carton having a depth of about 12 inches or less). Typically, the base, whether it is a base that is ballast fillable or supports weights, required packaging that is not relatively flat. Additionally, to pack the component parts of the basketball system frequently required cardboard or styrofoam dividers to prevent undesirable shifting and damage to the components during shipping. Such dividers add cost to the price ultimately charged to the consumer and become waste to the consumer. It is not unusual for such dividers to add as much as five percent (5%) to the retail cost of the basketball system.

Thus, it would be an advancement in the art to provide a portable base for a basketball system which utilizes ballast secured within the base as a weight, but which can be easily moved by one person without having to remove the ballast from the base.

It would be a further advancement in the art if such a portable base could be provided which would have the capability to receive liquid (e.g., water) or solid particles (e.g., sand) as ballast without leaking or spilling.

It would also be an advancement in the art to provide a portable base for a basketball goal system which would have wheels that can support the effective weight of the system when the system is tilted from its game mode disposition so that the system can be maneuvered from one place to another without requiring the removal of the ballast.

Indeed, it would be an additional advancement in the art to provide a base for a basketball system to which a pole could be secured in a substantially vertical disposition, thereby providing a vertical support to which could be attached a backboard and goal.

It would be still another advancement in the art to provide a portable basketball system having component parts that are capable of assembly into a relatively flat carton for shipping, particularly if the exterior contour of the base for the system assisted in the packaging of the components so that packing dividers could be eliminated or dramatically reduced.

Such a device is disclosed and claimed herein.

BRIEF SUMMARY AND OBJECTS OF THE INVENTION

The present invention is directed to a portable basketball system with a ballast-fillable base that can be packaged for shipping into a relatively flat container (e.g., a carton or box). The component parts of the basketball system during preassembly can be positioned into a packaging and shipping assemblage that fits into an outer relatively flat container. The shape and size of the various component parts of the basketball system compliment each other so that the parts fit into the relatively flat carton thereby eliminating or drastically reducing the need for cardboard or styrofoam dividers or spacers.

In one embodiment, the basketball system includes a pole, a backboard, a basketball goal, a base, and bracing structure. The pole has a proximate end and a distal end and preferably comprises a plurality of pole sections which when joined together end to end form the pole.

The backboard may be connected to the pole near the distal end of the pole in any customary fashion that secures the plane of the backboard in a vertical plane. There are known in the art numerous ways to connect the backboard to the pole including adjustable mechanisms such as are taught in U.S. Pat. Nos. 4,781,375 and 4,805,904, angular support arms that connect a backboard to a pole that is disposed at an angle rather that vertical, and horizontal support arms which may or may not be capable of adjusting the height of the backboard by sliding the support arm up and down the pole before rigidly securing the support arm.

The basketball goal typically comprises a connecting plate, a rim, and a net and can be connected to the backboard in a customary fashion, rigidly or by using a breakaway mechanism. The connecting plate is to be secured to the backboard so that the plane of the rim lies in a horizontal plane above a playing surface.

The base together with the bracing structure may be connected to the pole to support the pole in a stationary, substantially upward disposition (for the purposes of this application substantially upward disposition shall include vertical disposition and a disposition angled from the vertical). The base has generally rectangular three-dimensional shape with a front, a rear, a top, and a bottom and the proximate end of the pole is to be connected to the front of the base. The bracing structure connects to the pole and the base to provide bracing support so that the pole is held in a stationary disposition whether it be vertical or angled from the vertical. When the pole is held in its stationary disposition it is secured so that the basketball goal can be suspended at an elevation above the base and the playing surface upon which the base rests.

The base of the present invention has an interior hollow cavity for receiving ballast material and an exterior contour for receiving and retaining the pole sections, backboard, and basketball goal within the container during preassembly. The hollow cavity is accessed through an opening preferably disposed in the rear of the base. A cap is provided to cover the opening so that the hollow cavity can be made water tight. Hence, the ballast material used to provide the weight needed to securely anchor the basketball system to the playing surface during a game mode may be water or a solid particle ballast such as sand, soil, metal beads or the like.

The base is designed to hold a predetermined amount of ballast material such that the weight of the ballast creates a sufficient moment about the front of the base where the pole connects to the base to counteract the moment resulting from the weight of the assembly of the pole, backboard, and basketball goal about the front of the base. The weight of the ballast material also provides sufficient support to the basketball system to maintain the system in a substantially rigid position during use of the basketball system in playing basketball (i.e., during its game mode).

The exterior contour of the base accommodates the receipt and retention of the other component parts in an assemblage that impedes shifting movement of the pole sections, backboard, and basketball goal within the container during shipping. Preferably, the exterior contour of the base has a backboard recess, a goal recess, and a pair of notches. The backboard recess may be disposed on the bottom of the base and is of the depth, size, and shape for receiving and retaining the backboard in secure but removable engagement. The goal recess may be disposed on the top of the base for receiving and retaining the basketball goal in snug but removable engagement. Preferably, each notch is disposed on the top of the base along a longitudinal edge of the base and each notch has a depth and length for receiving and retaining at least one of the pole sections in fitted removable engagement. Additionally, in a preferred embodiment, the opening and the hollow cavity in the base are sufficiently large to receive therethrough and therein at least one of the pole sections.

The pole sections have hollow interiors that serve as compartments for receiving and retaining therein smaller component parts of the basketball system such as the bracing structure, the adjustment mechanism or other form of connecting structure used to secure the backboard to the pole, and any other hardware needed to assemble the basketball system. Hence, by inserting the smaller component parts into the pole sections, no additional exterior dimension is added to the packaging and shipping assemblage of component parts to the basketball system.

By positioning the backboard within the backboard recess, the basketball goal within the goal recess, and the pole sections within the notches and/or through the opening into the hollow cavity of the base, the assemblage has exterior dimensions that permit the insertion of the assemblage into a relatively flat container for transport. Since the recesses and notches hold the parts snugly, the base impedes the shifting movement of the pole sections, backboard, basketball goal, and other small component parts within the container. Additionally, the need for cardboard or styrofoam dividers or spacers is eliminated or drastically reduced.

When fully assembled, the basketball system is moved by initially moving the pole into a tilted position (i.e., a position tilted from its stationary disposition) and rotating the basketball system into a reclined position. A set of wheels are provided at the front of the base which come into contact with the ground upon rotation of the basketball system into the reclined position. When the goal system is in its upright position, the wheels do not contact the ground. In the reclined position, with the basketball system supported upon the wheels, the system may be easily moved from one location to another.

Thus, it is an object of the present invention to provide a portable basketball system with a ballast-filled base for use in supporting the basketball system which can be easily moved from one location to another without removing the ballast from the base.

It is a further object of the present invention to provide such a base which is capable of receiving both liquid and solid particle ballast.

It is an additional object of the present invention to provide a portable base for a basketball system which would have wheels that can support the effective weight of the system when the system is tilted from its game mode disposition so that the system can be maneuvered from one place to another without requiring the removal of the ballast.

A further object of the present invention is to provide a base for a basketball system to which a pole could be secured in a substantially vertical disposition, thereby providing a vertical support to which could be attached a backboard and goal.

Another object of the present invention is to provide a portable basketball system having component parts that are capable of assembly into a relatively flat container for shipping, and particularly providing an exterior contour for the base for the system that assists in the packaging of the components so that packing dividers or spacers can be eliminated or dramatically reduced.

These and other objects and advantages of the present invention will become more fully apparent by examination of the following description of the preferred embodiments and the accompanying drawings.

DETAILED DESCRIPTION OF THE PREFERRED EMBODIMENTS

Figure 1:
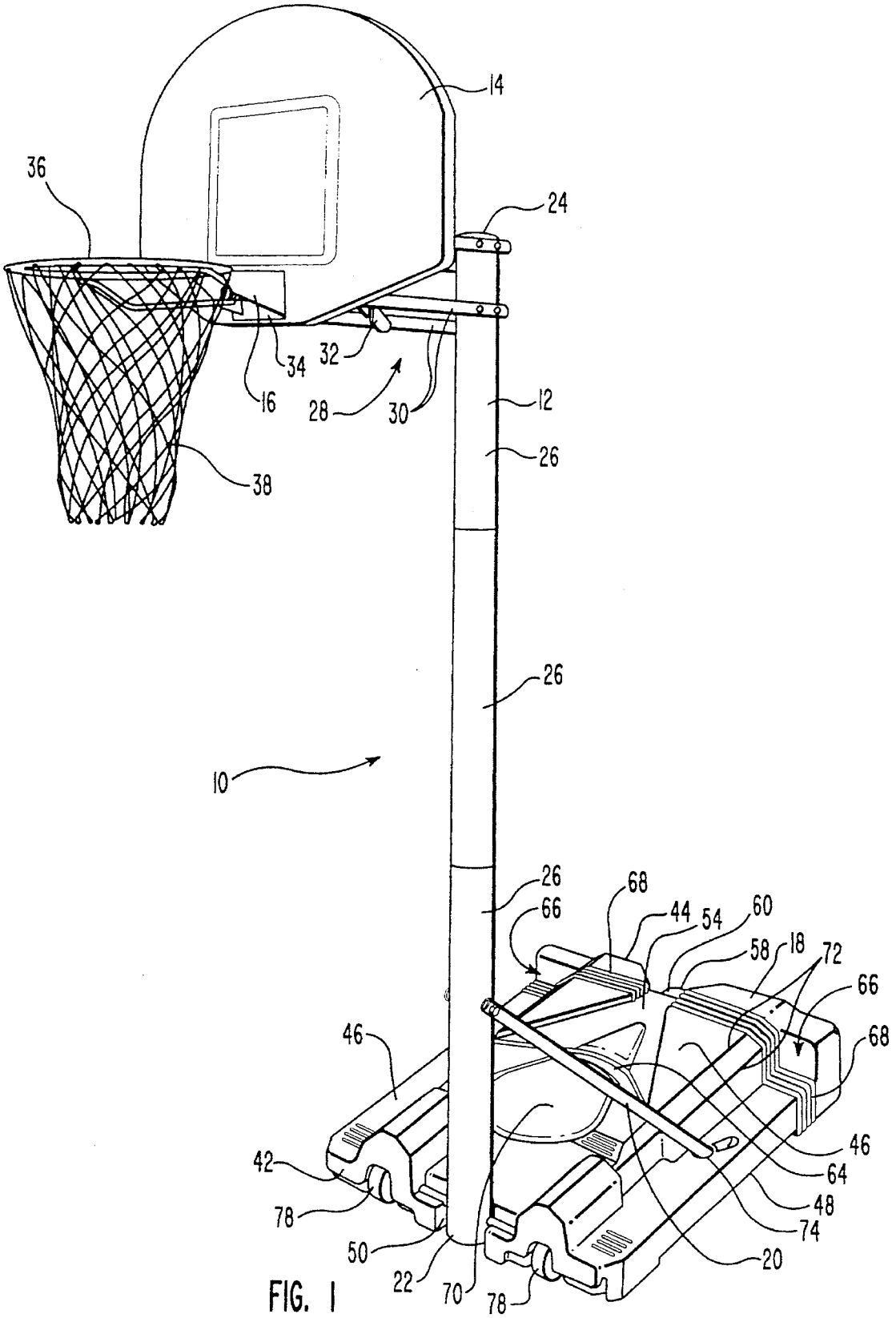
FIG. 1 is a perspective view of one embodiment of the portable basketball system with a ballast-filled base of the present invention as it would appear with a pole, backboard, and basketball goal attached to the base.

Reference is now made to the figures wherein like parts are referred to by like numerals throughout. With particular reference to FIG. 1, a portable basketball system according to the present invention is generally designated at 10. The basketball system 10 comprises a pole 12, a backboard 14, a basketball goal 16, a base 18, and bracing structure 20.

The pole 12 has a proximate end 22 and a distal end 24 and preferably comprises a plurality of pole sections 26 which when joined together end to end form the pole 12. The pole sections 26 may be joined together end to end in any conventional manner. One method for joining the pole sections 26 together may employ the fastener-free joint disclosed and claimed in U.S. Pat. No. 5,090,837.

The backboard 14 may be connected to the pole 12 near the distal end 24 of the pole 12 in any customary fashion that secures the plane of the backboard 14 in a vertical plane. As disclosed above, there are numerous ways known in the art to connect the backboard 14 to the pole 12. One preferred way is to use an adjustable mechanism 28 such as is taught in U.S. Pat. No. 4,805,904 and shown in FIG. 1. Such adjustable mechanisms 28 utilize a parallelogrammatic structure 30 and a bracing strut 32 which deforms the parallelogrammatic structure 30 according to the height desired for the backboard 14.

Although one form of adjustable mechanism 28 is shown in FIG. 1, it should be understood that this invention contemplates the use of any known connection of the backboard 14 to the pole 12. For example, other adjustable mechanisms can be used, as well as angular support arms that connect a backboard 14 to a pole 12 that is disposed at an angle rather than vertical or horizontal support arms which may or may not be capable of adjusting the height of the backboard 14 by sliding the support arm up and down the pole 12 before rigidly securing the support arm. Each of these forms of connection are known in the art and the use of each is considered to be within the scope and intent of the present invention.

The basketball goal 16 typically comprises a connecting plate 34, a rim 36, and a net 38 and can be connected to the backboard 14 in a customary fashion, rigidly or by using a breakaway mechanism. In particular, the mounting mechanism for the basketball goal may include a break-away mounting mechanism such as that disclosed and claimed in U.S. Pat. No. 4,846,469. Whatever mounting mechanism is used, the connecting plate 34 is to be secured to the backboard 14 so that the plane of the rim 36 lies in a horizontal plane above a playing surface 40 (shown in FIG. 10).

The base 18 together with the bracing structure 20 may be connected to the pole 12 to support the pole 12 in a stationary, substantially upward disposition. Although the basketball system 10 shown in FIG. 1 illustrates a pole 12 disposed vertically, it is anticipated that the basketball system 10 may also utilize the pole 12 in a disposition angled from the vertical.

The bracing structure 20 connects to the pole 12 and the base 18 to provide bracing support so that the pole 12 is held in a stationary disposition whether it be vertical or angled from the vertical. When the pole 12 is held in its stationary disposition, the pole 12 is secured so that the basketball goal 16 can be suspended at an elevation above the base 18 and the playing surface 40 upon which the base 18 rests. When the pole 12 is in its stationary disposition, the basketball system 10 is in its game mode (i.e., ready for play of the game of basketball). Also, the basketball system 10 shown in FIG. 1 utilizes a pole 12 that is securely disposed (by bolt and nut engagement) in a vertical disposition, but it should be understood that a pole 12 that pivots with the base 18 is also contemplated by this invention. To enable the pole 12 to pivot with the base 18, the bracing structure 20 would be slidably secured to the pole 12. Thus, as the pole 12 pivots and moves from its generally vertical position to a tilted position, the bracing structure 20 supports the pole 12 while permitting the pole 12 to recline reducing the total vertical height of the basketball system 10. Such an embodiment would facilitate the storage of the basketball system 10 and is contemplated to be within the scope and intent of the present invention.

Turning now to FIGS. 3 through 9, the base 18 has a generally rectangular three-dimensional shape with a front 42, a rear 44, a top 46, and a bottom 48. It is preferred that the base 18 be constructed of a plastic such as polyethylene, although it will be appreciated that a variety of materials could be employed so long as the material can be structurally rigid but have some flexibility; a material that can be molded into the desired shape, but sturdy and rugged to withstand weather and rough play. In order to maintain minimum manufacturing costs, it is preferred that the base 18 be constructed using a two-piece blow molding process known in the plastics molding art. It is also preferred that the front 42 of the base 18 has a curvature 50 for receiving the proximate end 22 of the pole 12 (see FIG. 1). Within this curvature 50, the pole 12 is to be connected to the front 42 of the base 18.

The base 18 of the present invention has an interior hollow cavity 52 for receiving ballast material (not shown) and an exterior contour 54 for receiving and retaining the pole sections 26, backboard 14, and basketball goal 16 within a container 56 during preassembly. The hollow cavity 52 is accessed through an opening 58 defined by neck 60 and preferably disposed in the rear 44 of the base 18. A cap 62 (shown only in FIG. 7) is provided to engage the neck 60 and cover the opening 58 so that the hollow cavity 52 can be made water tight. Hence, the ballast material used to provide the weight needed to securely anchor the basketball system 10 to the playing surface 40 during game mode may be a liquid such as water or a solid particle ballast such as sand, soil, metal beads or the like.

The base 18 is designed to hold a predetermined amount of ballast material such that the weight of the ballast creates a sufficient moment about the front 42 of the base 18 where the pole 12 connects to the base 18 to counteract the moment resulting from the weight of the assembly of the pole 12, backboard 14, and basketball goal 16 about the front 42 of the base 18. The weight of the ballast material also provides sufficient support to the basketball system 10 to maintain the system 10 in a substantially rigid position during use of the basketball system 10 in its game mode.

Figure 2:
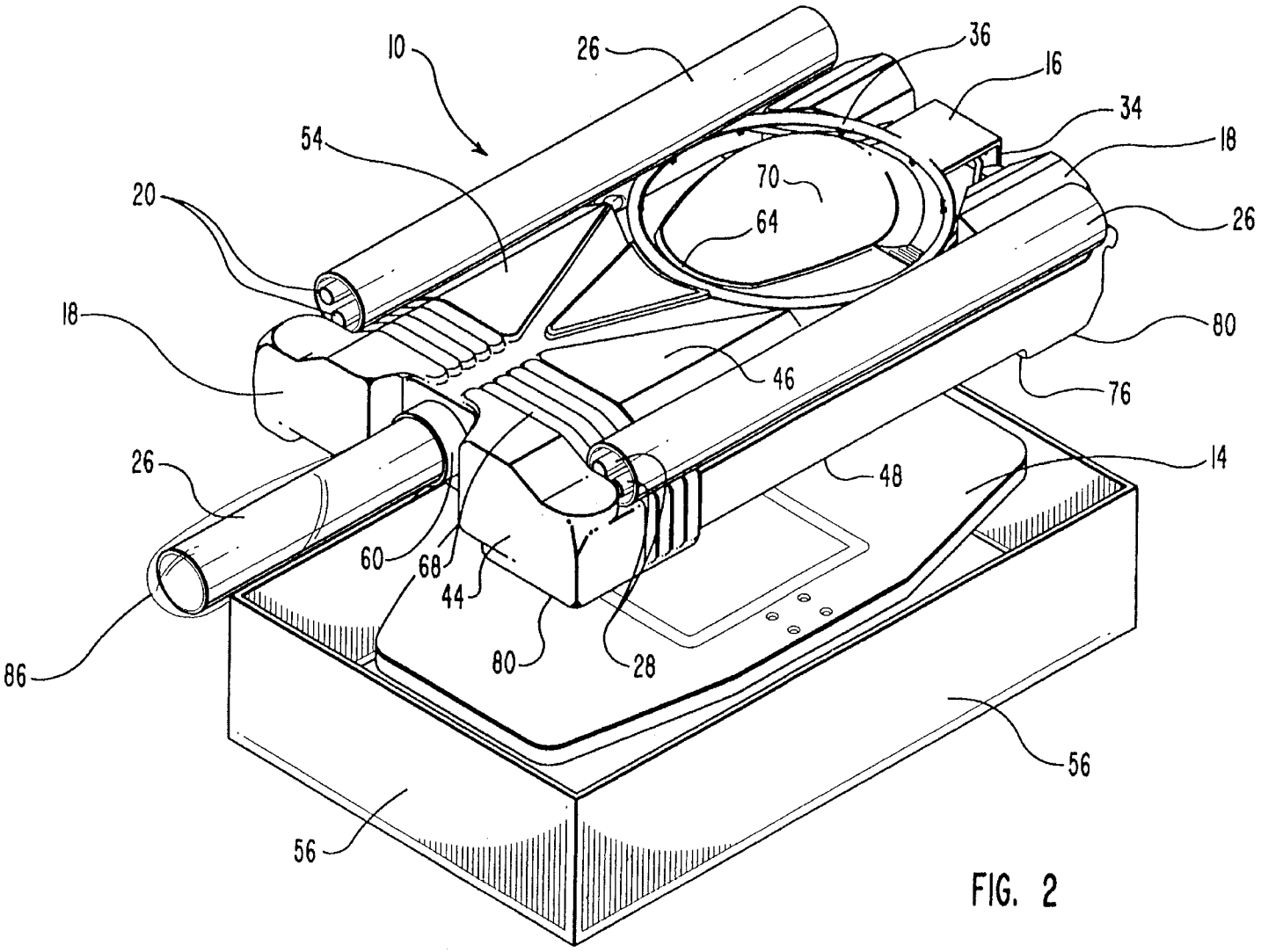
FIG. 2 is a perspective, exploded view of the basketball system of FIG. 1 in a preassembled state, with the component parts of the basketball system positioned to be received by the base in packing engagement for disposition within a relatively flat container (the lid for the container is not shown).
Figure 3:
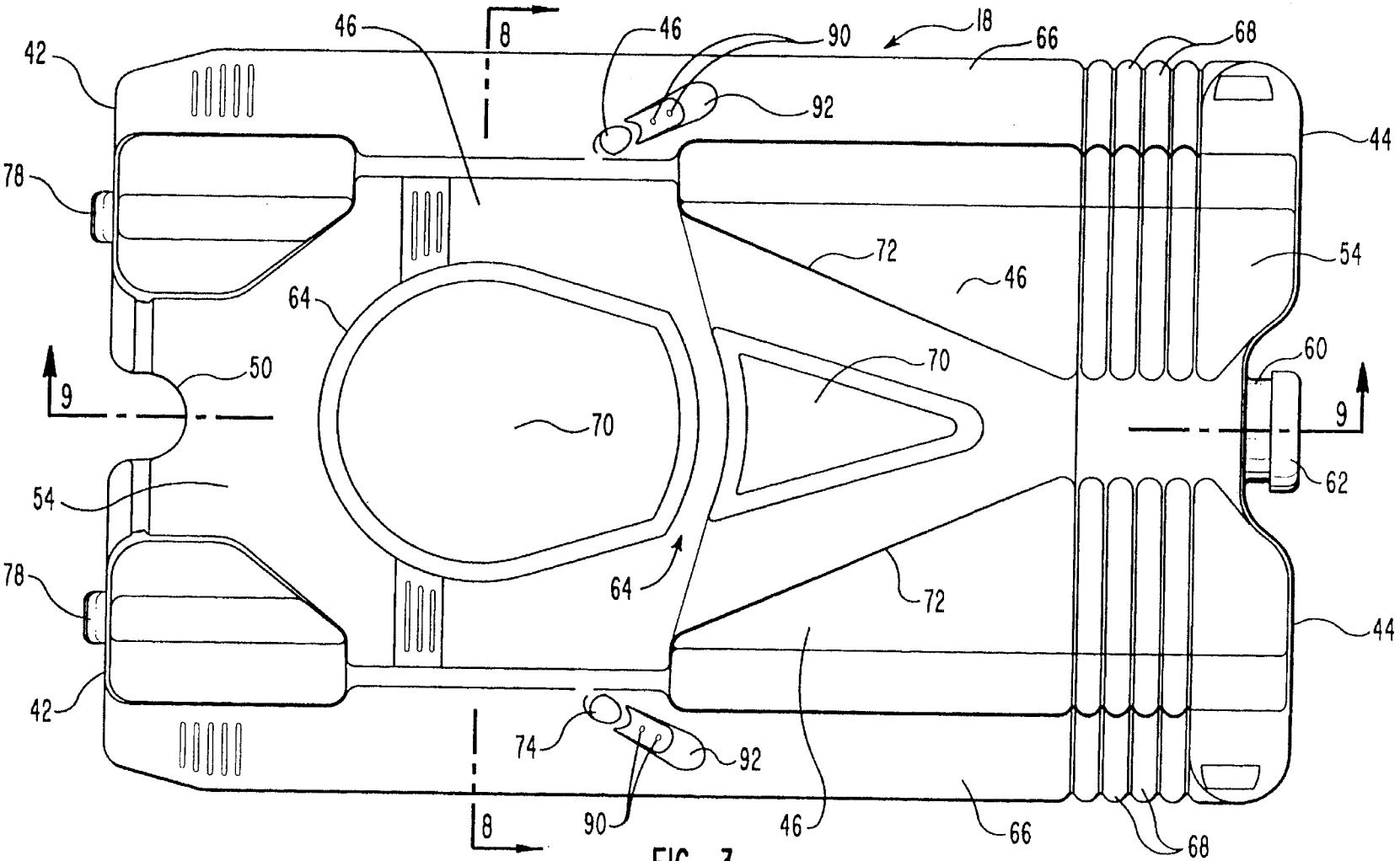
FIG. 3 is a top plan view of the base for the basketball system of FIG. 1 showing its generally rectangular shape and a preferred contour of the top of the base.

The exterior contour 54 of the base 18 accommodates the receipt and retention of the other component parts in an assemblage that impedes shifting movement of the pole sections 26, backboard 14, and basketball goal 16 within the container 56 during shipping (see FIG. 2). As illustrated in FIG. 3, the exterior contour 54 of the base 18 has a goal recess 64 and a pair of notches 66. The goal recess 64 is preferably disposed on the top 46 of the base 18 near the curvature 50. In this manner, the basketball goal 16 may be disposed within the goal recess 64 with the connecting plate 34 disposed within the void left by the curvature 50 and the rim 36 resting in a circular groove portion of the goal recess 64 (see FIG. 2). The goal recess 64 is capable of receiving and retaining the basketball goal 16 in snug but removable engagement.

Preferably, each notch 66 is disposed on the top 46 of the base 18 along a longitudinal edge of the base 18, although such notches 66 may be disposed elsewhere within the exterior contour 54 of the base 18 and still serve their function as described herein. As best shown in FIGS. 1 through 4, each notch 66 has a depth (approximating the diameter of the pole 12) and length (approximating the length of a pole section 26) for receiving and retaining at least one of the pole sections 26 in fitted removable engagement.

Additionally, the exterior contour 54 of the base 18 may employ structural ribs 68 and/or bubbles 70 or ridges 72 that provide strength to the structural integrity of the base 18 and/or maximize the size of the interior hollow cavity 52 to maximize the amount of ballast that the base 18 is able to retain. Such structural ribs 68, bubbles 70, and/or ridges 72 decrease deformation or sagging of the base 18 under the weight of the ballast. Although a particular preferred embodiment of the exterior contour 54 of the base is shown, it should be understood that any contour that facilitates the packaging of the component parts of the basketball system 10 into an assemblage that is relatively flat is contemplated and intended to be within the spirit and scope of the present invention. Hence, the particular disposition of the goal recess 64 and the notches 66 may be altered from that shown in the figures without departing from the scope of the invention.

As illustrated in FIG. 3, receiving apertures 74 are provided in the base 18 for receiving the ends of the bracing structure 20 (see FIG. 1) and the ends of the bracing structure 20 can be secured therein by conventional fastening means. However, it is preferred that the receiving apertures 74 are formed as shown principally in FIGS. 3, 7, 11, and 12 so that the bracing structure 20 can be firmly attached to the base 18. To facilitate the firm attachment of the bracing structure 20 to the base 18, the base 18 together with the receiving apertures 74 has a thick anchoring wall 88 with angled bolt bores 90 and an indentation 92. Fasteners 94 such as a nut and bolt are disposed through the angled bolt bores 90 and the bracing structure 20 so that the bracing structure 20 abuts against the anchoring wall 88 (see FIG. 11). The indentation 92 facilitates the placement of the fasteners 94 into the angled bolt bores 90.

Figures 11, 12:
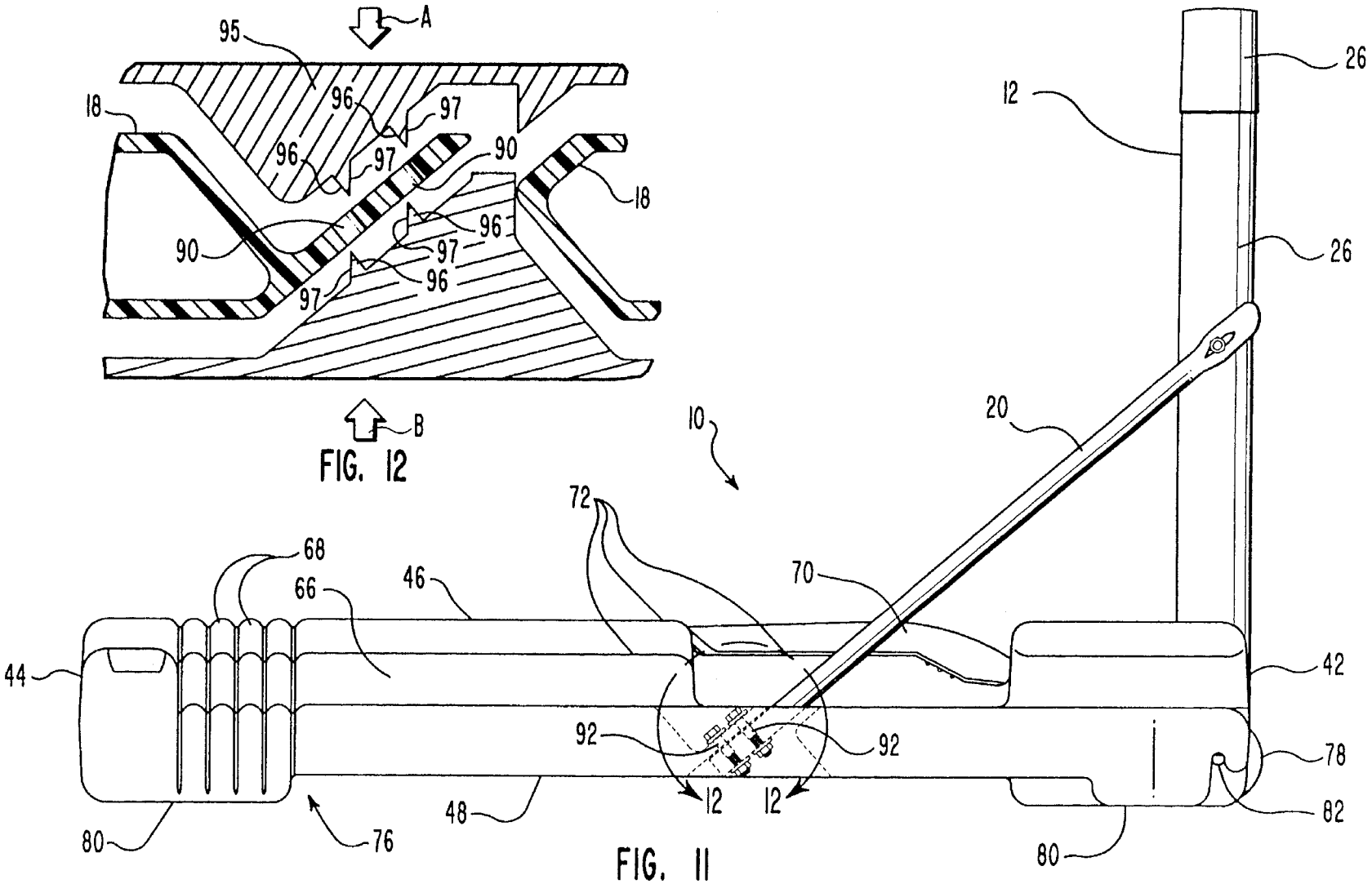
FIG. 11 is a side elevation view of the basketball system of the present invention showing the receiving apertures and a portion of the bracing structure in phantom lines.
FIG. 12 is an enlarged view of area 12—12 shown in FIG. 11 illustrating the molding process by which angled bolt holes can be constructed in the base to secure the bracing structure.

To construct the thick anchoring wall 88 with angled bolt bores 90 by using a two-piece blow molding process, mold elements 95 having nubs 96 with complementary slanted faces 97 are required as shown in FIG. 12. Hence, an angled bore such as the angled bolt bores 90 can be constructed by having opposite mold elements 95 come together from opposite directions as shown by Arrows A and B. During molding, the mold elements 95 are forced together with the molding material from which the base 18 is constructed therebetween. The nubs 96 are aligned so that the slanted faces 97 of each mold element 95 meet as shown by the phantom line of FIG. 12. In this manner, about half of each of the angled bolt bores 90 are formed by a nub 96 on one mold element 95 while the other half of each angled bolt bore 90 are formed by its complementary nub 96 of the other mold element 95.

Figure 4:
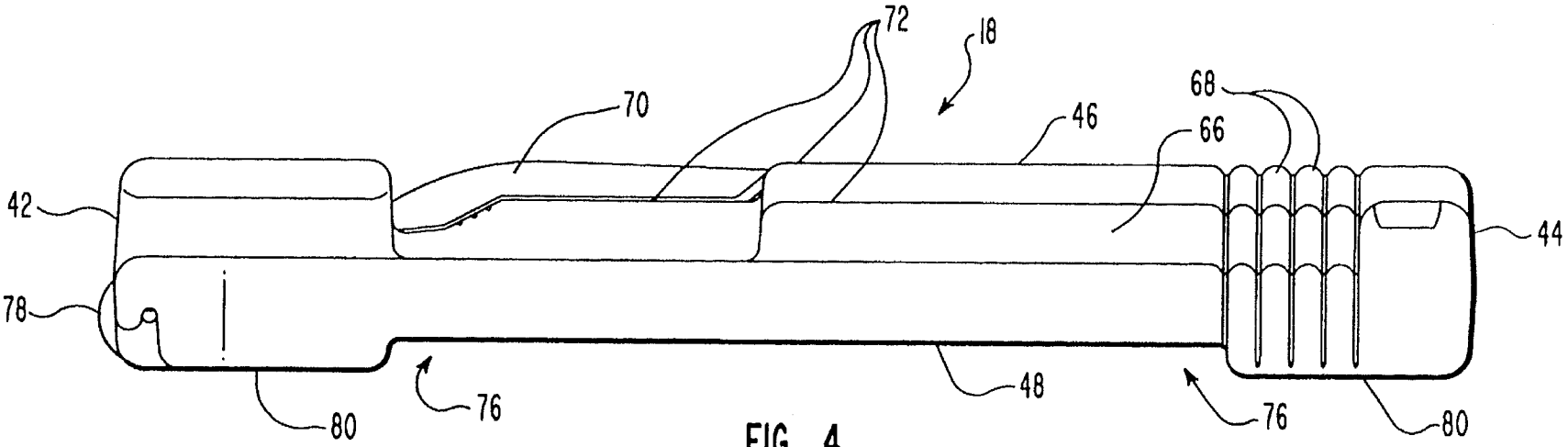
FIG. 4 is a side elevation view of the base for the basketball system of FIG. 1 illustrating the relative flatness of the base and the contour of the base as viewed from the side.
Figure 7:
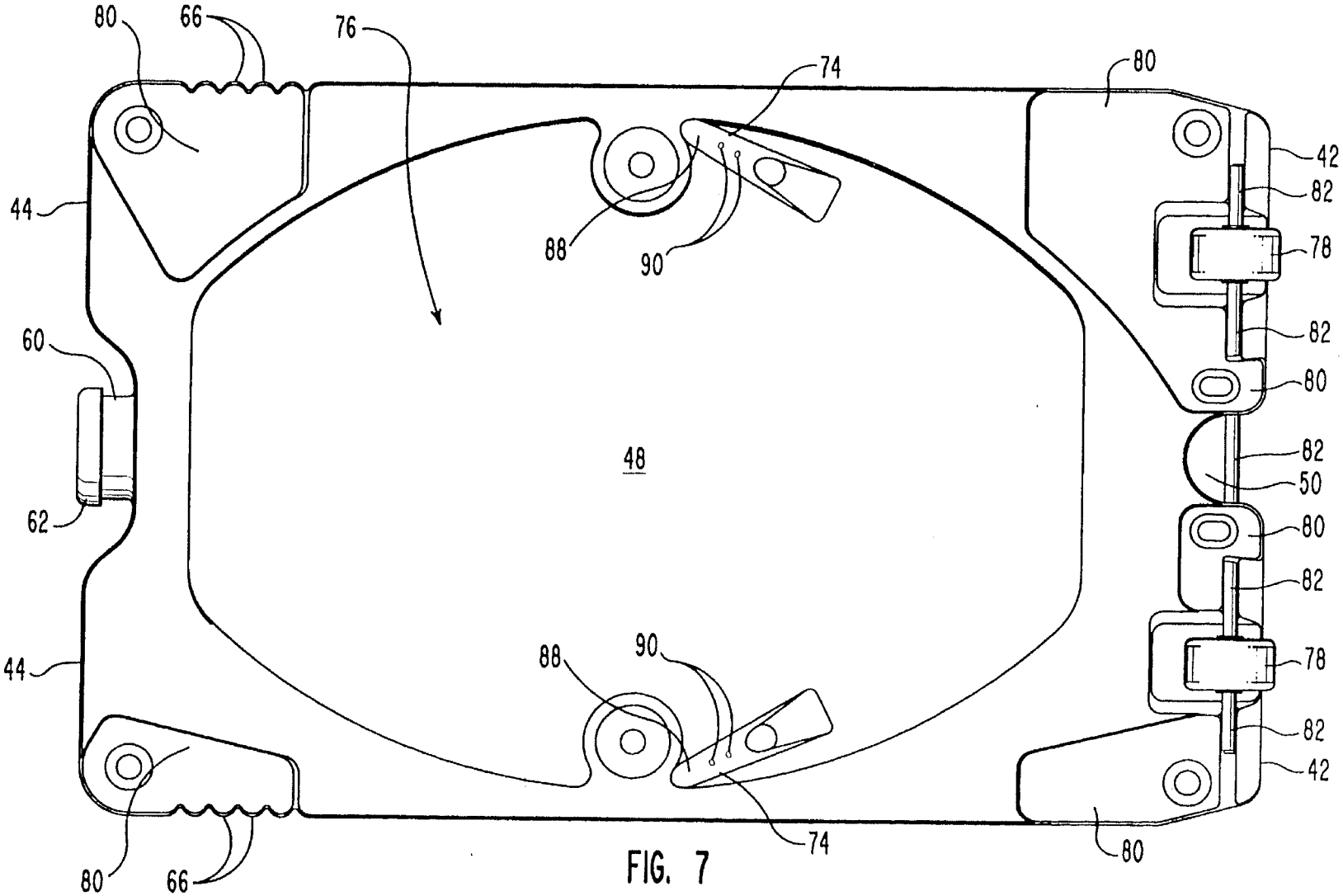
FIG. 7 is a plan view of the bottom of the base for the basketball system of FIG. 1 showing its generally rectangular shape and a preferred contour of the bottom of the base.
Figure 8:
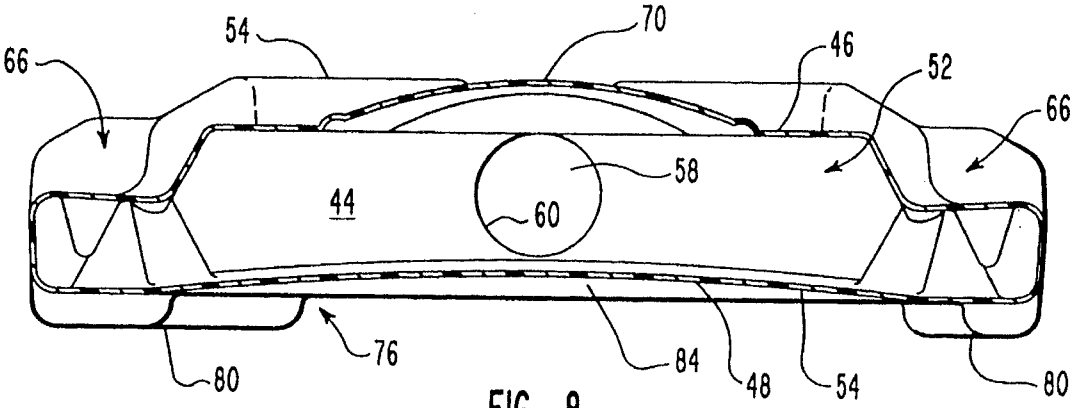
FIG. 8 is a transverse sectional view of the base for the basketball system of the present invention along line 8—8 of FIG. 3 showing the interior hollow cavity and the configuration of the base before ballast is introduced into the hollow cavity.
Figure 9:
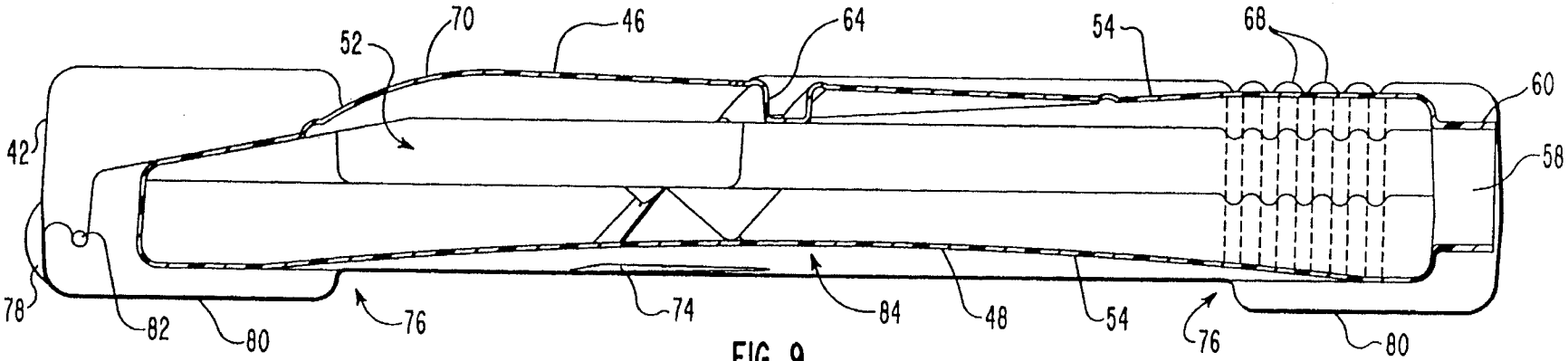
FIG. 9 is a longitudinal section view of the base for the basketball system of the present invention along line 9—9 of FIG. 3 showing the interior hollow cavity and the configuration of the base before ballast is introduced into the hollow cavity.

A backboard recess 76 is shown principally in FIGS. 4 and 7 as disposed on the bottom 48 of the base 18. The backboard recess 76 has the depth, size, and shape for receiving and retaining the backboard 16 in secure but removable engagement. As shown in FIG. 2, the backboard 16 is received into the backboard recess 76 so that the backboard 16 is disposed flat on the floor of the container 56. Having the backboard recess 76 on the bottom 48 of the base 18 is a preferred embodiment, but it should be understood that a different exterior contour 54 may accommodate the backboard recess 76 on the top 46 of the base 18.

Figure 5:
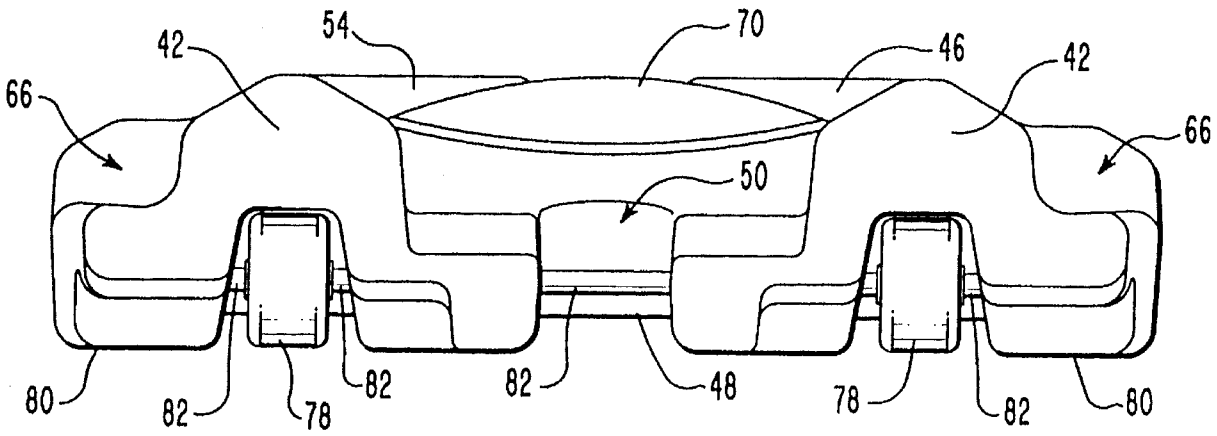
FIG. 5 is an elevation view of the front of the base for the basketball system of FIG. 1 illustrating a preferred frontal configuration of the base and the wheels upon which the basketball system may be supported during transport along a surface from one location to another.

FIG. 5 shows the front 42 of the base 18 and wheels 78 disposed to facilitate the movement of the basketball system 10 from one place to another. A set of wheels 78 are disposed at the front 42 of the base 18 so that the wheels 78 come into contact with the ground upon rotation of the basketball system 10 from the game mode into a reclined position (see FIG. 10), as will be explained in more detail below. When the basketball system 10 is in its upright, game mode position, the wheels 78 do not contact the ground or playing surface 40. In the reclined position, the effective weight of the basketball system 10 is supported upon the wheels 18, and the system 10 may be easily moved from one location to another.

Figure 6:
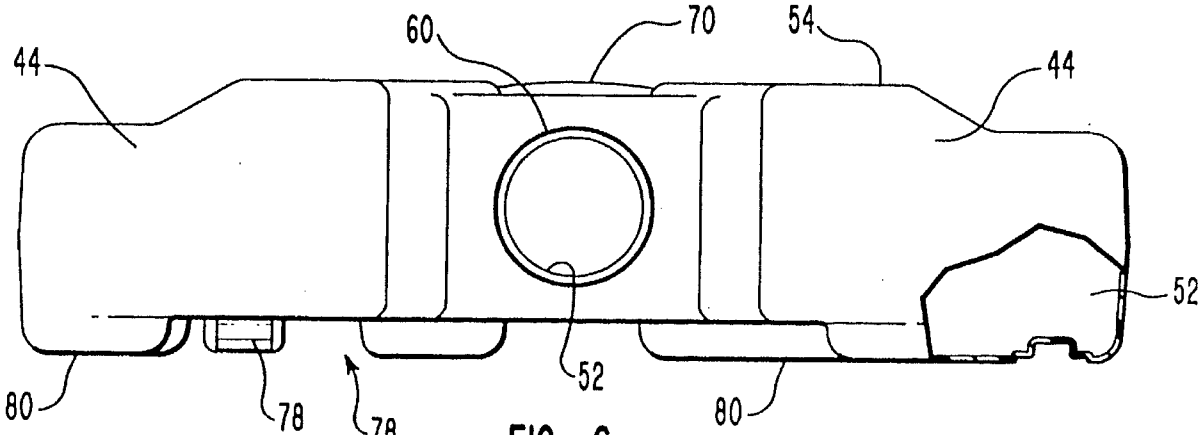
FIG. 6 is an elevation view of the rear of the base for the basketball system of FIG. 1 illustrating a preferred rear configuration of the base and showing a portion of the base cut away to show the hollow interior of the base.

FIG. 6 illustrates a preferred embodiment of the rear 44 of the base 18 showing the opening 58 and the interior hollow cavity 52, and the backboard recess 76. In a preferred embodiment, the opening 58 and the hollow cavity 52 in the base 18 are sufficiently large to receive therethrough and therein at least one of the pole sections 26. For example, if the neck 60 has a diameter only slightly larger than a pole section 26, the neck can prevent the pole section 26 from shifting within the hollow cavity 52 or becoming lodged within the hollow cavity 52 in manner making it difficult to remove the pole section 26 for assembly of the basketball system 10. Interior barriers (not specifically shown) can also serve to assist in preventing the pole section 26 from shifting within the hollow cavity 52 or becoming lodged within the hollow cavity 52.

If the ballast used to fill the hollow cavity 52 is a liquid such as water, it is advisable to fill the hollow cavity 52 to a water level which leaves approximately 10 percent of the volume of the hollow cavity 52 empty. Leaving a void within the hollow cavity 52 ensures room for expansion in the event water within the hollow cavity 52 freezes. Because water expands as it freezes, if expansion were not accounted for, it could cause the base 18 to crack or otherwise fail.

The bottom 48 of the base 18, as best shown in FIG. 7, has the backboard recess 76 and skid plates 80. The backboard recess 76 is capable of capturing the backboard 14 in releasable engagement and retaining the backboard 14 flat against the bottom of the base 18. The skid plates 80 serve as friction footings against the playing surface 40 when the base 18 is filled with ballast and the assembled basketball system 10 is disposed in game mode. When the base 18 is filled with ballast, the bottom 48 of the base 18 will deflect towards the playing surface 40. To compensate for this deformation, the bottom 48 is slightly angled to an apex 84 as shown best in FIGS. 8 and 9. Thus, when the base 18 is filled with ballast, the unique design of the bottom 48 permits the skid plates 80 to lay flat against the playing surface 40, and resists the sagging of the bottom 48. Otherwise, only the outside corner of the skid plates 80 would contact the playing surface 40, causing premature wear of the skid plates 80 and sagging stress on the base 18.

In the preferred embodiment of the present invention, the axle for each wheel 78 and the connection for the pole 12 to the base 18 is provided by a single rod 82 which spans the width of the base 18 as shown best in FIG. 7. Although the wheels 78 and the pole 12 may be connected in any number of ways known, it is preferred that the configuration using the single rod 82 be utilized because it minimizes the component parts and the rod 82 can easily fit within the packaging assemblage without adding exterior dimension to the assemblage.

To assemble the basketball system 10 of the present invention as shown in FIG. 1, the backboard 14 is connected to the pole 12 near its distal end 24. The basketball goal 16 is connected to the backboard 14. The hollow ballast-receiving base 18 is connected to the pole 12 near its proximate end 22 so that said basketball goal 16 is suspended at an elevation above the base 18 and the playing surface 40. The bracing structure 20 is then secured to the pole 12 and the base 18 so that the pole 12 is supported in a stationary, substantially upward disposition. For safety reasons it is advisable to fill the base 18 with ballast before securing the pole 12 into its stationary upward disposition because the weight of the ballast is needed to counteract the moment about the front 42 of the base 18 created by the weight of the pole 12, backboard 14, and basketball goal 16. When so assembled, the basketball system 10 is ready for play.

Figure 10:
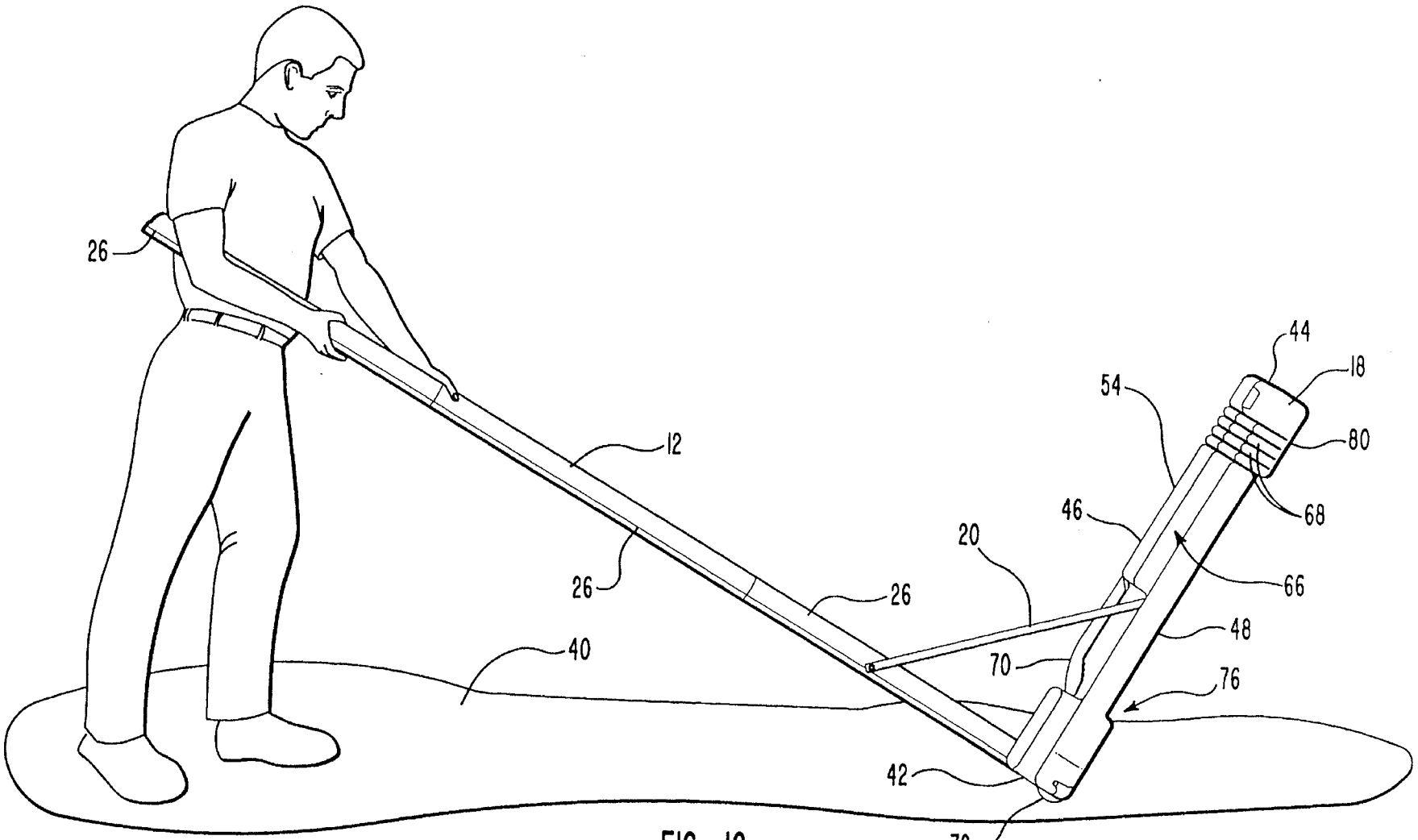
FIG. 10 is a perspective view of a preferred embodiment of the basketball system of FIG. 1, with the goal system in its reclined position and illustrating how the goal system may be moved from one location to another.

When fully assembled, the basketball system 10 is moved by initially moving the pole 12 into a tilted position (i.e., a position tilted from its stationary disposition) and rotating the basketball system 10 into a reclined position. The wheels 78 provided at the front 42 of the base 18 come into contact with the ground or playing surface 40 upon rotation of the basketball system 10 into the reclined position, as best shown in FIG. 10. In the reclined position, the effective weight of the basketball system 10 (i.e, the weight experienced by the wheels resulting from the weight of the system 10 as affected by the countervailing forces acting as moments about the wheels 78) is supported upon the wheels 78 and the wheels 78 serve as a rotating fulcrum for the system 10. In this manner, the basketball system 10 may be easily moved from one location to another without requiring the removal of the ballast from the base 18.

The component parts of the basketball system 10 can, in a preassembled state, form an assemblage that facilitates packaging and shipment. As best shown in FIG. 2, the component parts can form an assemblage that is capable of disposition within a relatively flat container 56. The pole sections 26 have hollow interiors that serve as compartments for receiving and retaining therein smaller component parts of the basketball system 10 such as the bracing structure 20, the adjustment mechanism 28 or other form of connecting structure used to secure the backboard 14 to the pole 12, and any other hardware needed to assemble the basketball system 10. Hence, by inserting the smaller component parts into the pole sections 26, no additional exterior dimension is added to the packaging and shipping assemblage of component parts to the basketball system 10.

By positioning the backboard 14 within the backboard recess 76, the basketball goal 16 within the goal recess 64, and the pole sections 26 within the notches 66 and/or through the opening 58 into the hollow cavity 52 of the base 18, the assemblage has exterior dimensions that permit the insertion of the assemblage into a relatively flat container 56 for transport. Small articles of hardware can be retained within any of the pole sections 26 and prevented from undesirable jostling within the container 56 by placing such articles in a bag 86 and/or placing the bag 86 about the pole section 26 as shown in FIG. 2. Such a bag 86 disposed about pole section 26 can also assist in preventing undesirable scratching of the exterior of the pole section 26. Since the recesses and notches hold the parts snugly, the base 18 impedes the shifting movement of the pole sections 26, backboard 14, basketball goal 16, and other small component parts within the container. Additionally, the need for cardboard or styrofoam dividers or spacers is eliminated or drastically reduced because the base serves as the dividers or spacers.

To prepare the assemblage for shipping, the backboard 14 is positioned within the backboard recess 76. The basketball goal 16 is positioned within the goal recess 64. The remaining component parts that will fit into the pole sections 26 are inserted into the pole sections 26 (see FIG. 2) and the pole sections 26 are positioned within notches 66 and/or the hollow cavity 52 through opening 58. The assemblage so formed is then inserted into the container 56. If the basketball system 10 comprises an adjustable mechanism 28 for adjustably connecting the backboard 14 to the pole 12 so that the height of the basketball goal 16 above said base 18 is adjustable, then the component parts of the adjustable mechanism 28 are inserted within at least one of the pole sections 26 prior to positioning the pole section 26 with relation to the base 18.

Hence, it can be seen from the foregoing that the present invention includes portable basketball system 10 with a ballast-filled base 18 which can be easily moved from one location to another without removing the ballast from the base 18. The invention provides such a basketball system 10 which is uniquely designed such that in a preassembled state its component parts can be positioned to fit into a relatively flat shipping container 56.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A basketball packaging and shipping assemblage for disposition within an outer relatively flat container and capable of assembly with a backboard and a pole into a basketball system, the packaging and shipping assemblage comprising:

a basketball goal for connection to the backboard;

a hollow ballast-receiving base capable of assembly with said basketball goal and with the backboard and the pole to form the basketball system wherein said base supports the pole in a stationary, substantially upward position and said basketball goal is connected to the backboard which is connected to the pole so that said basketball goal is suspended at an elevation above said base, said base having an exterior contour for receiving and retaining said basketball goal within the container and impeding shifting movement of said basketball goal within the container during shipping, the exterior contour of said base comprising a goal recess for receiving and retaining said basketball goal within the container.

2. A basketball packaging and shipping assemblage as defined in claim 1, wherein the exterior contour of said base further comprises a backboard recess for receiving and retaining the backboard within the container.

3. A basketball packaging and shipping assemblage for disposition within an outer relatively flat container and capable of assembly with a basketball goal and a pole into a basketball system, the pole comprising a plurality of pole sections, the packaging and shipping assemblage comprising:

a backboard for connection to the pole;

a hollow ballast-receiving base capable of assembly with said backboard and with the basketball goal and the pole to form the basketball system wherein said base supports the pole in a stationary, substantially upward position and said basketball goal is connected to said backboard which is connected to the pole so that the basketball goal is suspended at an elevation above said base, said base having an exterior contour for receiving and retaining said backboard within the container and impeding shifting movement of said backboard within the container during shipping, the exterior contour of said base comprising a backboard recess for receiving and retaining said backboard within the container.

4. A basketball packaging and shipping assemblage as defined in claim 3, wherein the exterior contour of said base further comprises at least one notch for receiving and retaining at least one of said pole sections within the container.

5. A basketball system comprising:

a plurality of pole sections capable of assembly to form a pole having a proximal end and a distal end;

a backboard for connection to said pole near the distal end of said pole;

a basketball goal for connection to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base, said base having an exterior contour for receiving and retaining said basketball goal and for impeding shifting movement of said basketball goal during transport of said base.

6. A basketball system as defined in claim 5, wherein the exterior contour of said base comprises a goal recess for receiving and retaining said basketball goal within the container.

7. A basketball system as defined in claim 5, wherein said exterior contour of said base is configured for receiving and retaining said backboard and for impeding shifting movement of said backboard during transport of said base.

8. A basketball system as defined in claim 7, wherein the exterior contour of said base comprises a backboard recess for receiving and retaining said backboard.

9. A basketball system as defined in claim 5, wherein said exterior contour of said base is configured for receiving and retaining said pole sections and for impeding shifting movement of said pole sections during transport of said base.

10. A basketball system as defined in claim 9, wherein the exterior contour of said base comprises at least one notch for receiving and retaining at least one of said pole sections within the container.

11. A basketball system comprising:

a plurality of pole sections capable of assembly to form a pole having a proximal end and a distal end;

a backboard for connection to said pole near the distal end of said pole;

a basketball goal for connection to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base, said base having an exterior contour for receiving and retaining said backboard and for impeding shifting movement of said backboard during transport of said base.

12. A basketball system as defined in claim 11, wherein the exterior contour of said base comprises a backboard recess for receiving and retaining said backboard.

13. A basketball system as defined in claim 11, wherein the exterior contour of said base comprises a goal recess for receiving and retaining said basketball goal within the container.

14. A basketball system as defined in claim 11, wherein said exterior contour of said base is configured for receiving and retaining said pole sections and for impeding shifting movement of said pole sections during transport of said base.

15. A basketball system as defined in claim 14, wherein the exterior contour of said base comprises at least one notch for receiving and retaining at least one of said pole sections within the container.

16. A basketball system comprising:

a plurality of pole sections capable of assembly to form a pole having a proximal end and a distal end;

a backboard for connection to said pole near the distal end of said pole;

a basketball goal for connection to said pole; and a hollow ballast-receiving base capable of assembly with said pole, backboard, and basketball goal to form the basketball system wherein said base supports said pole in a stationary, substantially upward disposition and is connected to said pole near the proximal end of said pole and wherein said basketball goal and said backboard are connected to said pole so that said basketball goal is suspended at an elevation above said base, said base having an exterior contour for receiving and retaining said pole sections and for impeding shifting movement of said pole sections during transport of said base.

17. A basketball system as defined in claim 16, wherein the exterior contour of said base comprises at least one notch for receiving and retaining at least one of said pole sections within the container.

18. A basketball system as defined in claim 16, wherein the exterior contour of said base comprises a backboard recess for receiving and retaining said backboard.

19. A basketball system as defined in claim 16, wherein the exterior contour of said base comprises a goal recess for receiving and retaining said basketball goal within the container.

* * * * *